United States Patent [19]

Maier et al.

[11] Patent Number: 4,493,115

[45] Date of Patent: Jan. 15, 1985

[54] FIREARM RECOIL PROTECTION SYSTEM

[75] Inventors: Bruce R. Maier; Lincoln R. Flannery, both of Columbia, Mo.

[73] Assignee: P.A.S.T. Corporation, Columbia, Mo.

[21] Appl. No.: 384,922

[22] Filed: Jun. 4, 1982

[51] Int. Cl.[3] ..... A41D 13/00

[52] U.S. Cl. ..... 2/2; 2/45; 2/95; 2/268

[58] Field of Search ..... 2/2, 45, 95, 268

[56] References Cited

U.S. PATENT DOCUMENTS

| | | | |
|---|---|---|---|
| 1,587,946 | 6/1926 | Gibson | 2/2 |
| 2,014,991 | 9/1935 | Snyder | 2/2 |
| 2,986,738 | 6/1961 | Zubiate | 2/268 X |
| 3,257,666 | 6/1966 | Hoffman | 2/2 |
| 3,504,377 | 4/1970 | Biggs et al. | 2/2 |
| 4,353,133 | 10/1982 | Williams | 2/268 X |

*Primary Examiner*—Louis K. Rimrodt

*Attorney, Agent, or Firm*—Willian, Brinks, Olds, Hofer, Gilson & Lione, Ltd.

[57] ABSTRACT

A recoil protection system is disclosed which includes a fabric yoke. A leather panel is stitched to the yoke with a foam pad confined in the volume between the leather panel and the yoke. The foam pad is sized with its rest volume somewhat larger than the volume defined by the leather panel and the yoke such that the foam pad is in a constant state of compression. The foam pad is formed of a material having a high Loss Factor, and the yoke is held in place on the shoulder of the user by means of a harness which includes first and second straps, each of which passes under a respective arm of the user. Preferred materials for exceptionally effective foam pads are disclosed.

16 Claims, 3 Drawing Figures

FIREARM RECOIL PROTECTION SYSTEM

BACKGROUND OF THE INVENTION

This invention relates to an improved recoil protection system to be positioned against the shoulder of a user such that the recoil pad is interposed between the shoulder of the user and the stock of a firearm held by the user.

Firearm recoil can be a significant problem, particularly in connection with high caliber and high velocity firearms. Such firearms can deliver a significant impact against the shoulder of a user, impact which can lead to shoulder bruising and damage and to reduced aiming accuracy due to anticipatory flinching. Thus, a need exists for an improved firearm recoil protection device to protect the shoulder of a user from firearm recoil.

SUMMARY OF THE INVENTION

The present invention is directed to an improved firearm recoil protection device which is comfortable to wear and which provides excellent recoil protection.

According to one feature of this invention, a recoil protection device is provided which includes a pad of a shock absorbing material having an unusually high Loss Factor. It has been found in laboratory measurements that such high Loss Factor materials provide excellent shock attenuation so as to reduce materially the peak shock per unit area delivered to the shoulder of the user.

The high Loss Factor pad of this invention functions particularly well when it is used in a recoil protection device which confines the pad in an envelope having a volume less than the rest volume of the pad. In this case, shocks delivered to the pad are spread to an area significantly larger than the area of the firearm stock delivering the shock. This is because local deformation of the pad directly under the firearm stock causes deformation of the envelope, which in turn tends to compress adjacent regions of the pad. Of course, such spreading serves to reduce the peak loading per unit area delivered to the shoulder of the user. Envelopes of the type described above function particularly well when provided with a roughened surface against the pad so as to create an effective frictional engagement between the panel of the envelope adjacent the firearm stock and the pad. Such frictional engagement serves to reduce sliding action between the envelope and the pad, and therefore further to increase the spreading of the shock.

According to a third feature of this invention, the envelope described above is provided with a mounting yoke which conveniently holds the envelope in place between the firearm stock and the shoulder of the user. This mounting yoke includes a flexible yoke which extends over the top of the user's shoulder such that the envelope is positioned adjacent the front of the shoulder, and the back of the yoke extends across the top of the shoulder to the back of the user. Two straps are provided extending between the two ends of the yoke. One strap is a short strap which extends under the arm of the user adjacent to the envelope. The other strap is somewhat longer, and it extends across the chest, under the other arm, and across the back of the user. It has been found that this mounting yoke is particularly convenient to use and that it minimizes interference with normal movement of the arms and torso of the user. Furthermore, this mounting yoke is comfortable to wear, and it provides a minimum of bulk.

The invention itself, together with further objects and attendant advantages, will best be understood by reference to the following detailed description taken in conjunction with the accompanying drawings.

DETAILED DESCRIPTION OF THE PRESENTLY PREFERRED EMBODIMENTS

Figure 1:
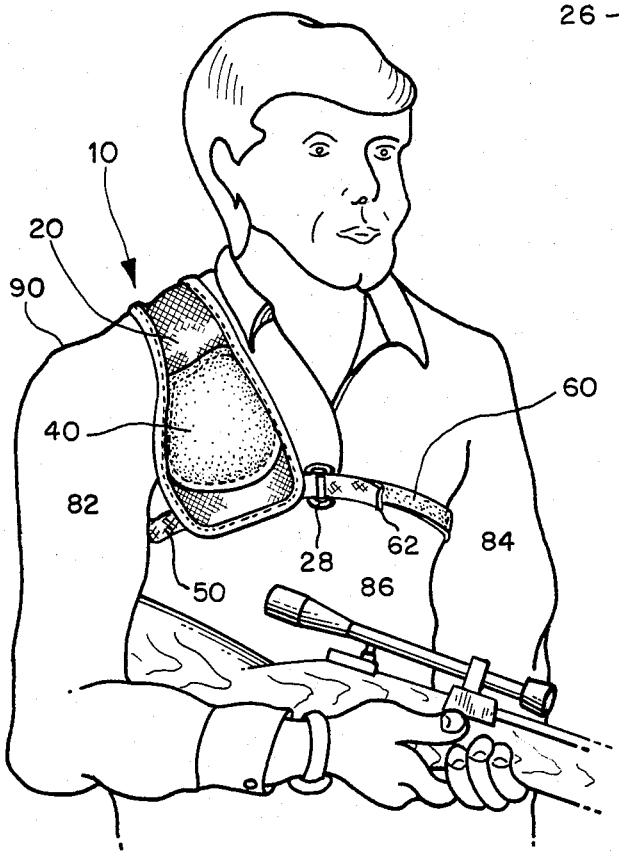
FIG. 1 is a perspective view showing a first preferred embodiment of the firearm recoil protection system of this invention positioned on a shoulder of a user.
Figure 2:
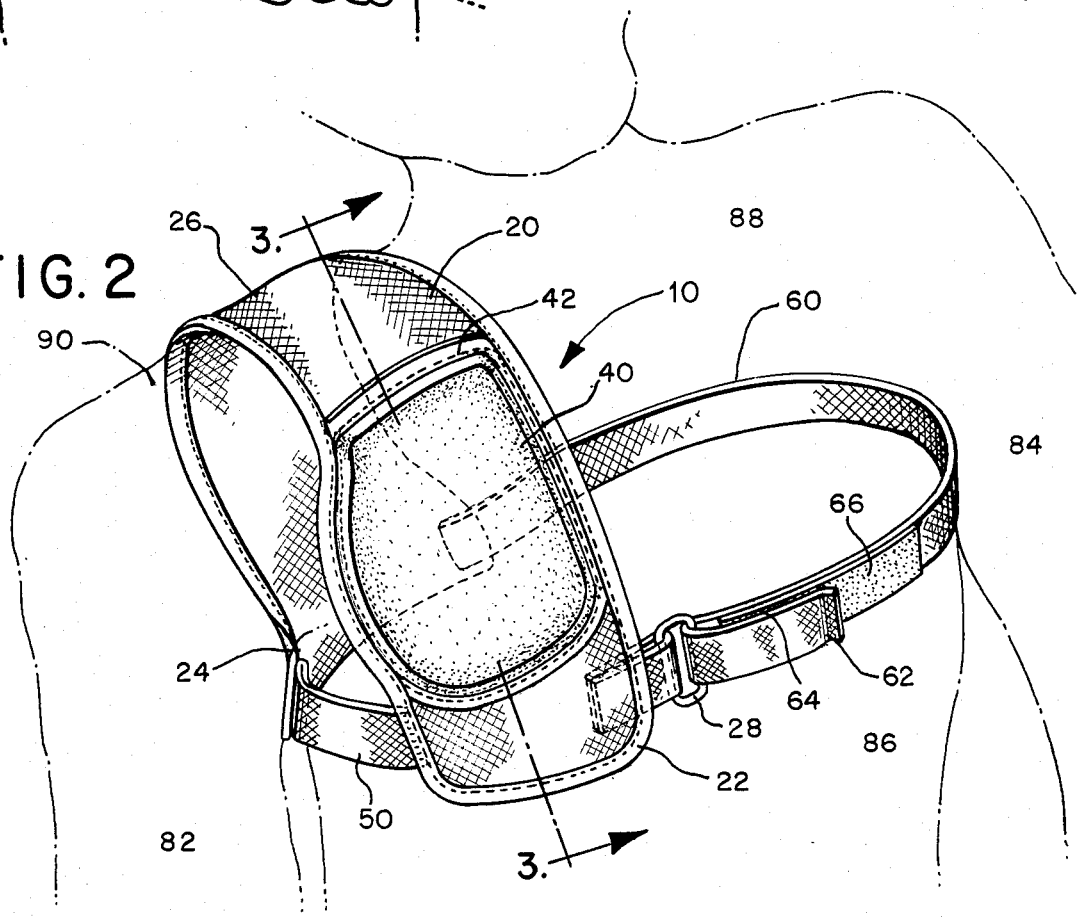
FIG. 2 is a perspective view of the embodiment of FIG. 1 in which the outline of the user is shown in dotted lines.

Turning now to the drawings, FIGS. 1 and 2 show a preferred embodiment of the recoil protection system of this invention, as it appears when worn by a user. This protection device 10 includes a yoke 20, which is provided with a first end section 22, an opposed second end section 24, and a mid-section 26 positioned between the two end sections 22, 24. In this preferred embodiment, the yoke 20 is formed of a fabric such as 60-40 Raymar, for example, and a metal ring 28 is secured to the yoke 20 at the first end section 22.

A flexible, energy absorbing pad 30 is positioned adjacent the first end section 22 of the yoke 20. This pad 30 is preferably in the range of one-quarter to one-half inch in thickness and is shaped to be large enough to cover the area of the shoulder which will serve to support the stock of the firearm, without being unduly cumbersome. Preferably, the pad 30 is formed of a material having a high Loss Factor. As used herein, the term "Loss Factor" is used as defined at page 439 of the text *Noise and Vibration Control,* by Leo L. Beranek (McGraw Hill, 1971). Preferably, the pad is formed of the foam described in U.S. Pat. No. Re. 29,487, which is supplied by the Cabot Company of Boston, Mass. under part numbers C-3001-25 and C-3001-50. This foam has a Loss Factor not less than 0.5 at 100 Hz. and not less than 1.0 at 10 Hz., and a Dynamic Youngs Modulus of $1.2\times10^7$ newtons/meter$^2$. The density of this foam is about 13 pounds per cubic foot.

The pad 30 is held in position on the yoke 20 by means of a leather panel 40. In this preferred embodiment, the leather panel 40 is secured directly to the yoke 20 by means of stitching 42. The stitching 42 is positioned on the leather panel 40 such that the contour of the stitching 42 on the leather panel 40 conforms to the shape of the pad 30 and is positioned about $\frac{1}{8}$ of an inch beyond the perimeter of the pad 30. In view of the thickness of the pad 30, this location of the stitching 42 insures that the leather panel 40 cooperates with the yoke 20 to form an envelope having an interior volume less than the rest volume of the pad 30. This means that the leather panel 40 cooperates with the yoke 20 to compress the pad 30, even prior to the time the stock of a firearm is positioned against the leather panel 40. In this preferred embodiment, the leather panel 40 is formed of a $2\frac{1}{2}$ oz per square foot, finished, top-grain, split cow hide. The interior surface of the leather panel 40 is a roughened leather surface which provides a high coefficient of friction between the leather panel 40 and the pad 30.

The protection device 10 also includes two straps 50, 60. The first strap 50 is positioned to extend between the first and second end sections 22, 24. The first strap 50 is relatively short, and is formed of an elastic material.

A second strap 60 also extends between the first and second end sections 22, 24, and is opposed to the first strap 50. This second strap 60 is considerably longer than the first strap 50 and it includes a free end 62. This free end 62 is sized to fit within the ring 28. The free end 62 is provided with a section 64 defining multiple hooks. The strap 60 also defines a somewhat longer region 66 which defines a multiplicity of fabric type loops. The two regions 64, 66 cooperate to form a conventional hook and loop fastener. Thus, by passing the free end 62 of the second strap 60 through the ring 28 and then pressing the hook section 64 against a selected portion of the loop section 66, the effective length of the second strap 60 can be adjusted readily. In this embodiment, the strap 60 is formed of a nylon webbing.

Figure 3:
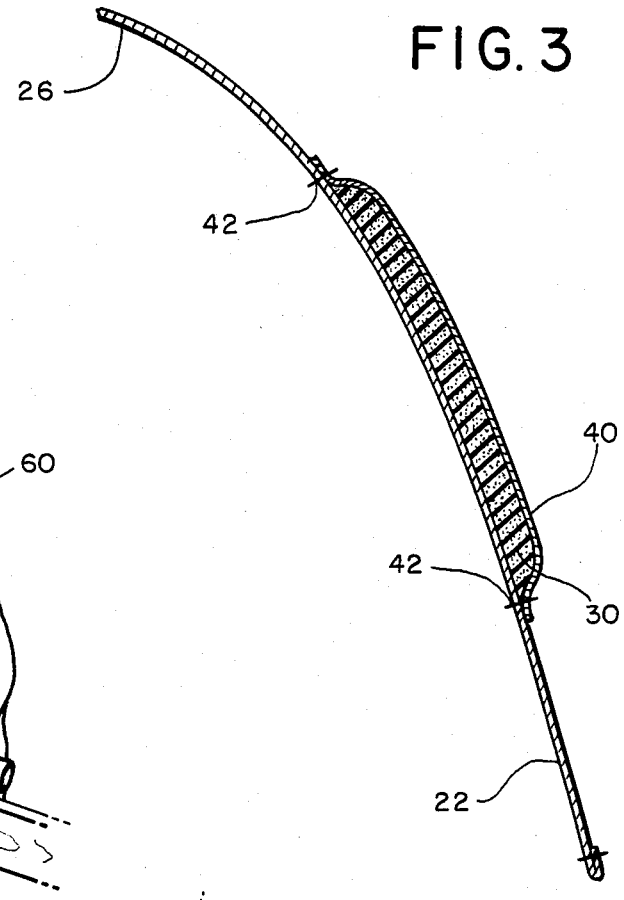
FIG. 3 is a sectional view taken along lines 3—3 of FIG. 2.

FIG. 3 is a sectional view which shows the manner in which the pad 30 is confined between the leather panel 40 and a portion of the yoke 20. It should be noted that the pad 30 substantially fills the interior volume defined between the leather panel 40 and the yoke 20.

FIGS. 1 and 2 show the manner in which the protection system 10 is used. The yoke 20 is positioned such that the first strap 60 extends under an arm 82 of the user and the yoke 20 extends from the front to the back of the shoulder 80, passing over the top 90 of the shoulder of the user. The second strap 60 extends across the chest 86 and the back 88, under the other arm 84 of the user. It has been found that this mounting harness provides a particularly comfortable protection device which is securely held in place and yet does not interfere with the freedom of movement of the user. In use, the user holds a firearm such as a high caliber rifle (not shown) with the stock of the firearm resting directly on the leather panel 40. When the firearm is fired, recoil is passed from the stock of the firearm via the leather panel 40 and the pad 30 to the shoulder 80 of the user. However, because of the excellent shock absorbing characteristics of the pad 30 as confined in the envelope defined by the leather panel 40 and the yoke 20, peak shock as well as peak loading per unit area applied to the shoulder 80 are markedly reduced by the protection system 10.

The excellent shock absorbing characteristics of the pad 30 contribute to the effectiveness of the protection system 10. In addition, the manner in which the pad 30 is confined within the envelope to produce a confined pad system significantly enhances the effectiveness of this system 10, because it ensures that shocks applied to the pad 30 by the stock of the firearms are spread to adjacent portions of the pad 30. Thus, the leather panel 40 cooperates with the pad 30 to provide a particularly effective recoil protection device. The roughened rear surface of the leather panel 40 provides excellent frictional engagement between the leather panel 40 and the pad 30 in order further to increase the volume of the pad 30 which is distorted by the stock of the firearm.

From the foregoing, it should be apparent that an improved recoil protection system has been described which is conveniently used and which provides excellent recoil protection. Of course, it should be understood that many changes and modifications to the preferred embodiment described above will be apparent to those skilled in the art. For example, other materials having suitable physical characteristics may be substituted for the material shown. Filled or plasticized or polymerized cellulose derivatives and filled or plasticized petroleum derivatives with Loss Factor as low as 0.1 can be used as shock absorbing pads, and the thickness of these pads may be adjusted to provide the degree of protection needed for any particular application. In addition, the novel confined pad system of this invention can be employed in recoil protection devices having other types of means for mounting the envelope adjacent the body of the user. For example, the confined pad system can be sewn, pinned, or held in a pocket in a conventional garment, such as a shirt, vest or jacket. Alternately, the confined pad system can be secured to the stock of a firearm, as by rubber or synthetic polymer enclosures, for example, so as to come between the stock and the shoulder of the user. Moreover, buckles or snaps can be substituted for the hook and loop fastener disclosed above.

It is therefore intended that the foregoing detailed description be regarded as illustrative rather than as limiting, and that it be understood that it is the following claims, including all equivalents, which are intended to define the scope of this invention.

I claim:

1. In a firearm recoil protection system of the type comprising an energy absorbing pad having a rest volume, a flexible envelope surrounding the pad, and means for positioning the envelope over a front portion of a shoulder of a user such that the envelope is situated to come between the shoulder of the user and the stock of a firearm held by the user, the improvement comprising:

an enclosed cavity defined by the envelope, said enclosed cavity shaped to receive and confine the pad, said cavity having a volume less than the rest volume of the pad such that the envelope compresses the pad to a volume less than its rest volume, thereby enhancing recoil protection provided by the confined pad.

2. The invention of claim 1 wherein the envelope comprises a fabric panel on one side of the pad and a leather panel on the other side of the pad, wherein the leather panel is sewn to the fabric panel around the pad.

3. The invention of claim 1 wherein the positioning means comprises:

a flexible yoke secured to the top of the envelope and shaped to extend over the top and partially down the back of the shoulder of the user;

a first strap mounted between the bottom of the envelope and the yoke, said strap positioned to extend under the arm of the user adjacent the shoulder; and a second strap extending between the bottom of the envelope and the yoke, said second strap positioned and shaped to extend across the back, under the other arm, and across the chest of the user.

4. The invention of claim 3 wherein the first strap is formed of an elastic material and means are provided for adjusting the length of the second strap.

5. The invention of claim 3 wherein the yoke is formed of a fabric material, and the yoke fabric material forms one side of the envelope.

6. The invention of claim 1 wherein the positioning means comprises means for securing the envelope to the stock of a firearm.

7. The invention of claim 7 wherein the securing means comprises an elastomeric enclosure secured to the stock of the firearm.

8. The invention of claim 1 wherein the positioning means comprises means for securing the envelope to a garment.

9. The invention of claim 1 wherein the pad is formed of a material having a Loss Factor not less than about 0.1.

10. The invention of claim 1 wherein the pad is formed of a material having a Loss Factor not less than about 0.5.

11. A firearm recoil attenuation system comprising:

a flexible fabric yoke having a first end section and a second end section, said yoke sized to fit over a shoulder of a user such that the yoke extends over the top of the shoulder with the first end section positioned on the front of the shoulder and the second end section positioned on the rear of the shoulder;

an energy absorbing flexible pad positioned over the yoke adjacent the first end section, said pad having a rest volume;

a leather panel secured to the yoke around the foam pad such that a confined volume is defined between the leather and the yoke, said volume chosen to be less than the rest volume of the pad such that the leather panel and the yoke closely confine the pad, thereby enhancing recoil attenuation of the confined pad;

a first strap extending between the first and second end sections of the yoke under one arm of the user; and a second strap extending from the first end section, across the chest, under the other arm, across the back of the user to the second end section of the yoke to secure the yoke in place.

12. The invention of claim 11 wherein the invention further comprises:

means for detachably securing the second strap to the first end section of the yoke.

13. The invention of claim 12 wherein the securing means comprises a ring mounted to the first end section of the yoke and a hook and loop fastener mounted between two parts of the second strap.

14. The invention of claim 11 wherein the first strap is formed of an elastic material.

15. The invention of claim 11 wherein the pad is characterized by a Loss Factor not less than 0.1.

16. The invention of claim 15 wherein the pad is characterized by a Loss Factor not less than about 0.5.

* * * * *